US010845721B2

(12) United States Patent
Tanaka et al.

(10) Patent No.: US 10,845,721 B2
(45) Date of Patent: Nov. 24, 2020

(54) TONER

(71) Applicant: CANON KABUSHIKI KAISHA, Tokyo (JP)

(72) Inventors: Masatake Tanaka, Yokohama (JP); Tsuneyoshi Tominaga, Suntou-gun (JP); Noriyoshi Umeda, Suntou-gun (JP); Satoshi Otsuji, Yokohama (JP); Shinsuke Mochizuki, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/600,790

(22) Filed: Oct. 14, 2019

(65) Prior Publication Data

US 2020/0124999 A1 Apr. 23, 2020

(30) Foreign Application Priority Data

Oct. 19, 2018 (JP) ..... 2018-197856

(51) Int. Cl.

*G03G 9/08* (2006.01)
*G03G 9/087* (2006.01)
*G03G 9/093* (2006.01)
*G03G 9/097* (2006.01)

(52) U.S. Cl.

CPC ..... *G03G 9/09364* (2013.01); *G03G 9/08711* (2013.01); *G03G 9/08726* (2013.01); *G03G 9/08755* (2013.01); *G03G 9/08782* (2013.01); *G03G 9/08795* (2013.01); *G03G 9/08797* (2013.01); *G03G 9/09328* (2013.01); *G03G 9/09733* (2013.01)

(58) Field of Classification Search

CPC ..... G03G 9/09733; G03G 9/08726; G03G 9/08711; G03G 9/08795; G03G 9/08797; G03G 9/08782; G03G 9/09328; G03G 9/09364

See application file for complete search history.

(56) References Cited

U.S. PATENT DOCUMENTS 5,851,714 A * 12/1998 Taya ..... G03G 9/081 430/108.3
6,326,114 B1 * 12/2001 Itakura ..... G03G 9/08755 430/108.3
6,929,894 B2 * 8/2005 Sugahara ..... G03G 9/0821 430/108.1
7,135,263 B2 11/2006 Kawakami et al.
7,611,813 B2 11/2009 Ida et al.
7,833,685 B2 11/2010 Tanaka et al.
8,084,178 B2 * 12/2011 Tosaka ..... G03G 9/0806 430/108.4
8,114,562 B2 2/2012 Ishigami et al.
8,163,451 B2 * 4/2012 Hirose ..... G03G 9/08782 430/108.21
8,361,688 B2 * 1/2013 Kouyama ..... G03G 9/09733 430/108.4
8,372,573 B2 2/2013 Ayaki et al.
8,377,616 B2 2/2013 Tani et al.
8,383,313 B2 2/2013 Ayaki et al.
8,551,680 B2 10/2013 Ayaki et al.
8,628,899 B2 1/2014 Kawamura et al.
8,815,484 B2 8/2014 Tanaka et al.
9,158,216 B2 10/2015 Shimano et al.
9,261,806 B2 2/2016 Moribe et al.
9,285,697 B2 3/2016 Fukudome et al.
9,377,705 B2 6/2016 Shimano et al.
9,383,668 B2 7/2016 Noji et al.
9,423,708 B2 8/2016 Tominaga et al.
9,500,972 B2 11/2016 Tanaka et al.
9,575,424 B2 2/2017 Nakagawa et al.
9,599,919 B2 3/2017 Isono et al.
9,658,549 B2 5/2017 Tanaka et al.
9,720,340 B2 8/2017 Tominaga et al.
9,733,583 B2 8/2017 Kuroki et al.
9,733,584 B2 8/2017 Masumoto et al.
9,785,068 B2 10/2017 Umeda et al.
9,785,071 B2 10/2017 Shimano et al.
9,785,077 B2 10/2017 Abe et al.
9,829,816 B2 11/2017 Tanaka et al.

(Continued)

FOREIGN PATENT DOCUMENTS

EP 2 659 310 12/2017
JP 2003-287917 10/2003

(Continued)

OTHER PUBLICATIONS

U.S. Appl. No. 16/670,352, Kentaro Yamawaki, filed Oct. 31, 2019.
U.S. Appl. No. 16/728,050, Tsuneyoshi Tominaga, filed Dec. 27, 2019.
U.S. Appl. No. 16/728,060, Kentaro Yamawaki, filed Dec. 27, 2019.
U.S. Appl. No. 16/728,101, Taiji Katsura, filed Dec. 27, 2019.
U.S. Appl. No. 16/728,122, Masamichi Sato, filed Dec. 27, 2019.

(Continued)

*Primary Examiner* — Christopher D Rodee
(74) *Attorney, Agent, or Firm* — Venable LLP

(57) ABSTRACT

A toner has a toner particle that has a binder resin and a release agent, wherein when the temperature when G'=1.0×$10^5$ Pa in a dynamic viscoelastic measurement on the toner is denoted by Ta, and the glass transition temperature in a differential scanning calorimetric measurement on the toner is denoted by Tg, the Ta and the Tg satisfy the following formulas:

$$40° \text{ C.} \leq Tg \leq 70° \text{ C.},$$

$$60° \text{ C.} \leq Ta \leq 90° \text{ C., and}$$

$$0° \text{ C.} \leq Ta - Tg \leq 35° \text{ C.; and}$$

the toner has a storage elastic modulus G' having a minimum value in the range from 110° C. to 150° C. in a dynamic viscoelastic measurement on the toner.

8 Claims, No Drawings

(56) References Cited

U.S. PATENT DOCUMENTS

| | | | | |
|---|---|---|---|---|
| 9,829,820 | B2 | 11/2017 | Masumoto et al. | |
| 9,835,964 | B2 | 12/2017 | Yoshida et al. | |
| 9,897,932 | B2 | 2/2018 | Hotta et al. | |
| 9,904,193 | B2 | 2/2018 | Nakagawa et al. | |
| 9,921,501 | B2 | 3/2018 | Mochizuki et al. | |
| 9,958,801 | B2 | 5/2018 | Tanaka et al. | |
| 10,054,866 | B2 | 8/2018 | Tanaka et al. | |
| 10,429,757 | B2 | 10/2019 | Yoshida et al. | |
| 10,503,090 | B2 | 12/2019 | Tominaga et al. | |
| 10,545,422 | B2 | 1/2020 | Yamawaki et al. | |
| 2010/0035171 | A1 | 2/2010 | Watanabe et al. | |
| 2014/0356779 | A1 | 12/2014 | Hasegawa et al. | |
| 2014/0363184 | A1 | 12/2014 | Santo et al. | |
| 2015/0099224 | A1* | 4/2015 | Abe | G03G 9/08773 430/110.2 |
| 2016/0209767 | A1 | 7/2016 | Nagata et al. | |
| 2018/0129146 | A1 | 5/2018 | Kawamura et al. | |
| 2019/0332024 | A1 | 10/2019 | Umeda et al. | |
| 2020/0026208 | A1 | 1/2020 | Terui et al. | |
| 2020/0026209 | A1 | 1/2020 | Yagi et al. | |
| 2020/0035171 | A1 | 1/2020 | Telfer et al. | |

FOREIGN PATENT DOCUMENTS

| | | |
|---|---|---|
| JP | 2012-203124 | 10/2012 |
| JP | 2014-235400 | 12/2014 |

OTHER PUBLICATIONS

U.S. Appl. No. 16/728,151, Masatake Tanaka, filed Dec. 27, 2019.
U.S. Appl. No. 16/728,157, Shohei Kototani, filed Dec. 27, 2019.
Harazaki, "Energies of Vaporization and Molar Volumes (25° C.) of Atoms and Atomic Groups" in Tables 3 to 9 of Basic Coating Science (1986) 54-57.

* cited by examiner

TONER

BACKGROUND OF THE INVENTION

Field of the Invention

The present invention relates to the toner used in image-forming methods such as electrophotographic methods, electrostatic recording methods, and toner jet methods.

Description of the Related Art

Higher speeds and reduced power consumption have been required of printers and copiers in recent years, and the development of toners having an excellent low-temperature fixability and an excellent heat resistance is thus required. In response to these requirements, a number of methods have been proposed that utilize the sharp melt property of crystalline materials. However, a disadvantage to the use of crystalline materials is the concomitant reduction in the hot offset resistance and in the ejected sheet sticking resistance.

Japanese Patent Application Laid-open No. 2014-235400 discloses a toner having an improved hot offset resistance; this is achieved by controlling the degree of polymerization of the binder resin and controlling the storage elastic modulus (G'), as provided by measurement of the dynamic viscoelastic properties of the toner, into a prescribed range.

Japanese Patent Application Laid-open No. 2003-287917 discloses a toner having an improved hot offset resistance; this is achieved by the exhibition of a minimum value in both the storage elastic modulus (G') and the loss elastic modulus (G") in the temperature region equal to or greater than the softening temperature.

SUMMARY OF THE INVENTION

While the toner described in Japanese Patent Application Laid-open No. 2014-235400 has an improved hot offset resistance, this toner has been found to present the problem of a reduced gloss. While the toner described in Japanese Patent Application Laid-open No. 2003-287917 also has an improved hot offset resistance, this toner has been found to present the problems of a reduced low-temperature fixability and a reduced gloss. In both instances these properties reside in a trade-off relationship, and their co-existence at higher levels of expression is required.

The present invention provides a toner in which the low-temperature fixability, hot offset resistance, and a high gloss co-exist with other, and that exhibits resistance to the generation of fogging and an excellent ejected sheet sticking resistance.

The present invention relates to a toner having a toner particle that has a binder resin and a release agent, wherein when the temperature when $G'=1.0\times10^5$ Pa in a dynamic viscoelastic measurement on the toner is denoted by Ta, and the glass transition temperature in a differential scanning calorimetric measurement on the toner is denoted by Tg, the Ta and the Tg satisfy the following formulas:

$$40^\circ\ C. \leq Tg \leq 70^\circ\ C.,$$

$$60^\circ\ C. \leq Ta \leq 90^\circ\ C., \text{ and}$$

$$0^\circ\ C. \leq Ta - Tg \leq 35^\circ\ C.;$$

and the toner has a storage elastic modulus G' having a minimum value in the range from 110° C. to 150° C. in a dynamic viscoelastic measurement on the toner, wherein the dynamic viscoelastic properties are measured using a rotational plate rheometer at an oscillation frequency of 1.0 Hz (6.28 rad/s) and a ramp rate of 2.0° C./minute in temperature sweep mode in the temperature range from 50° C. to 160° C.

The present invention can thus provide a toner in which the low-temperature fixability, hot offset resistance, and a high gloss co-exist with other, and that exhibits resistance to the generation of fogging and an excellent ejected sheet sticking resistance.

Further features of the present invention will become apparent from the following description of exemplary embodiments.

DESCRIPTION OF THE EMBODIMENTS

Unless specifically indicated otherwise, the expressions "from XX to YY" and "XX to YY" that show numerical value ranges refer in the present invention to numerical value ranges that include the lower limit and upper limit that are the end points.

Also, "(meth)acrylic" in the present invention means "acrylic" and/or "methacrylic".

The toner according to the present invention is more particularly described in the following.

As a result of focused investigations directed to solving the problems described above for the prior art, the present inventors discovered that, for a toner having a toner particle that contains a binder resin and a release agent, these problems can be solved by controlling the viscoelastic characteristics of the toner.

That is, the toner according to the present invention is a toner having a toner particle that has a binder resin and a release agent, wherein when the temperature when $G'=1.0\times10^5$ Pa in a dynamic viscoelastic measurement on the toner is denoted by Ta, the glass transition temperature in a differential scanning calorimetric measurement on the toner is denoted by Tg, the Ta and the Tg satisfy the following formulas:

$$40^\circ\ C. \leq Tg \leq 70^\circ\ C.,$$

$$60^\circ\ C. \leq Ta \leq 90^\circ\ C., \text{ and}$$

$$0^\circ\ C. \leq Ta - Tg \leq 35^\circ\ C.;$$

and the toner has a storage elastic modulus G' having a minimum value in the range from 110° C. to 150° C. in a dynamic viscoelastic measurement on the toner.

The dynamic viscoelastic properties are measured using a rotational plate rheometer at an oscillation frequency of 1.0 Hz (6.28 rad/s) and a ramp rate of 2.0° C./minute in temperature sweep mode in the temperature range from 50° C. to 160° C.

Tg is the glass transition temperature according to differential scanning calorimetric measurement of the toner, and toner deformation becomes larger at above Tg. The heat resistance is excellent when Tg is at least 40° C., and the low-temperature fixability is excellent when Tg is not more than 70° C. Tg is preferably from 50° C. to 60° C.

Ta is the temperature when $G'=1.0\times10^5$ Pa in dynamic viscoelastic measurement on the toner. The durability is excellent when Ta is at least 60° C., and the low-temperature fixability is excellent when Ta is not more than 90° C. Ta is preferably from 70° C. to 85° C.

Ta−Tg represents the sharp melt property, and the low-temperature fixability is outstanding when this is not more than 35° C. Not more than 30° C. is preferred and not more than 27° C. is more preferred.

The hot offset and ejected sheet sticking become problems for such a toner having an outstanding low-temperature fixability. This ejected sheet sticking refers to the phenomenon wherein ejected sheets of paper adhere to one other through the fixed image.

Means that increases the degree of polymerization of the binder resin and increases the value of G' on the high temperature side can be considered for the method for improving the hot offset resistance here; however, this by itself is unsatisfactory because the gloss then undergoes a large decline.

Investigations by the present inventors showed that, when the sharp melt property is brought to the aforementioned excellent level, the hot offset resistance can be improved, while preserving the high gloss as such, by designing a toner such that G' has a minimum value at from 110° C. to 150° C. It was additionally found that the ejected sheet sticking resistance can also be improved.

A method is described below as one example of an advantageous means for obtaining the aforementioned toner; this method uses a styrene-acrylic resin for the binder resin and provides an organosilicon polymer-containing surface layer on the toner particle. The description provided below is an example, and the means of realization is not limited to this.

The Tg of the toner can be controlled by controlling the Tg of the binder resin. For example, when the binder resin is a styrene-acrylic resin, Tg can be controlled by changing, e.g., the degree of polymerization and the individual monomer proportions.

The Ta of the toner can be controlled by changing, e.g., the degree of polymerization and Tg of the binder resin and the amount of the organosilicon polymer.

The use of a crystalline plasticizer is an example of a specific means for producing Ta−Tg≤35° C. In order to improve the sharp melt property, the crystalline plasticizer is preferably a plasticizer having a molecular weight of not more than 1,500, and a material is preferably selected for which at least 8 mass parts is compatible with 100 mass parts of the binder resin. With regard to the presence/absence of compatibility, compatibility is judged to be present when transparency occurs according to visual observation. The use for the plasticizer of an ester compound with a structure represented by formula (2) or (3), infra, is more preferred.

In addition, preferably the following formula (1) is satisfied and more preferably the following formula (1)' is satisfied when solubility parameters (SP values) of the plasticizer and the binder resin are denoted by SPw and SPr, respectively, and a weight-average molecular weight of the plasticizer is denoted by Mw. The unit for the solubility parameter is $(cal/cm^3)^{1/2}$.

$$(SPr-SPw)^2 \times Mw \leq 680 \quad (1)$$

$$300 \leq (SPr-SPw)^2 \times Mw \leq 600 \quad (1)'$$

A satisfactory compatibility of the plasticizer with the binder resin can be obtained through the use of a plasticizer that satisfies formula (1).

In order to provide a minimum value for the storage elastic modulus G' at 110° C. to 150° C., for example, an organosilicon polymer-containing surface layer may be formed on the toner particle surface and the amount and strength of the organosilicon polymer of this surface layer may be controlled. The strength of the surface layer can be controlled by changing, for example, the type and amount of monomer and the reaction temperature and pH in the process of forming the organosilicon polymer, infra.

In terms of improving the durability, the maximum value of the storage elastic modulus G' at 70° C. and below is preferably at least $1\times10^6$ Pa.

In addition, the toner particle preferably contains a carboxy group-containing styrene resin having an acid value of from 5 mg KOH/g to 25 mg KOH/g. The ejected sheet sticking resistance is further improved when the acid value is at least 5 mg KOH/g, while environmental stability for the triboelectric charging is obtained when the acid value is not more than 25 mg KOH/g.

Based on the preceding, the mechanisms underlying the operation and effects of the present invention are considered to be as follows.

By having 0° C.≤Ta−Tg≤35° C., a plastic deformation sufficient to provide a high gloss occurs in a temperature range lower than the temperature at which G' assumes a minimum value. By having G' take on a minimum value in the prescribed temperature range, the G' of toner locally exposed during fixing to a temperature higher than the temperature providing this minimum value becomes relatively high, and the generation of hot offset is prevented as a consequence.

Moreover, the toner at the surface of the fixed image is exposed to the highest temperatures during fixing and normally is prone to engage in ejected sheet sticking. However, with the toner according to the present invention, G' takes on a minimum value at a lower temperature, and as a consequence G' for the toner at the surface of the fixed image is higher than normal. This means that the percentage elastic deformation is large, and this suppresses excessive melt spreading of the release agent plasticized during fixing and facilitates crystallization post-fixing, resulting in a suppression of ejected sheet sticking.

The use is preferred in the present invention of a carboxy group-containing styrene resin having an acid value of from 5 mg KOH/g to 25 mg KOH/g. It is thought that this resin has a high affinity for the plasticizer with the structure given by formula (2) or (3) and that during fixing this resin is compatibilized with the plasticizer, while after fixing it forms hydrogen bonds during the image cooling process and promotes the crystallization of the plasticizer and can thus improve the resistance to ejected sheet sticking.

The individual components constituting the toner and methods for producing the toner are described in the following.

Binder Resin

The toner particle contains a binder resin. The content of the binder resin is preferably at least 50 mass % with reference to the total amount of the resin component in the toner particle.

The binder resin is not particularly limited and can be exemplified by styrene-acrylic resins, epoxy resins, polyester resins, polyurethane resins, polyamide resins, cellulose resins, polyether resins, and their blended resins and composite resins. Styrene-acrylic resins and polyester resins are preferred from the standpoints of low price, ease of acquisition, and ability to provide an excellent low-temperature fixability. A styrene-acrylic resin is more preferably incorporated from the standpoint of providing an excellent development durability.

The polyester resin is obtained by synthesis, using a heretofore known method such as, for example, transesterification or polycondensation, from a combination of suitable selections from, e.g., polybasic carboxylic acids, polyols, hydroxycarboxylic acids, and so forth.

The polybasic carboxylic acids are compounds that contain two or more carboxy groups in each molecule. Among these, the dicarboxylic acids are compounds that contain two carboxy groups in each molecule, and their use is preferred.

Examples are oxalic acid, succinic acid, glutaric acid, maleic acid, adipic acid, β-methyladipic acid, azelaic acid, sebacic acid, nonanedicarboxylic acid, decanedicarboxylic acid, undecanedicarboxylic acid, dodecanedicarboxylic acid, fumaric acid, citraconic acid, diglycolic acid, cyclohexa-3,5-diene-1,2-dicarboxylic acid, hexahydroterephthalic acid, malonic acid, pimelic acid, suberic acid, phthalic acid, isophthalic acid, terephthalic acid, tetrachlorophthalic acid, chlorophthalic acid, nitrophthalic acid, p-carboxyphenylacetic acid, p-phenylenediacetic acid, m-phenylenediacetic acid, o-phenylenediacetic acid, diphenylacetic acid, diphenyl-p,p'-dicarboxylic acid, naphthalene-1,4-dicarboxylic acid, naphthalene-1,5-dicarboxylic acid, naphthalene-2,6-dicarboxylic acid, anthracenedicarboxylic acid, and cyclohexanedicarboxylic acid.

Polybasic carboxylic acids other than dicarboxylic acids can be exemplified by trimellitic acid, trimesic acid, pyromellitic acid, naphthalenetricarboxylic acid, naphthalenetetracarboxylic acid, pyrenetricarboxylic acid, pyrenetetracarboxylic acid, itaconic acid, glutaconic acid, n-dodecylsuccinic acid, n-dodecenylsuccinic acid, isododecylsuccinic acid, isododecenylsuccinic acid, n-octylsuccinic acid, and n-octenylsuccinic acid. A single one of these may be used by itself or two or more may be used in combination.

The polyols are compounds that contain two or more hydroxyl groups in each molecule. Among these, diols are compounds that contain two hydroxyl groups in each molecule, and their use is preferred.

Specific examples are ethylene glycol, diethylene glycol, triethylene glycol, 1,2-propylene glycol, 1,3-propylene glycol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, 1,20-eicosanediol, diethylene glycol, triethylene glycol, dipropylene glycol, polyethylene glycol, polypropylene glycol, polytetramethylene ether glycol, 1,4-cyclohexanediol, 1,4-cyclohexanedimethanol, 1,4-butenediol, neopentyl glycol, 1,4-cyclohexanediol, polytetramethylene glycol, hydrogenated bisphenol A, bisphenol A, bisphenol F, bisphenol S, and alkylene oxide (e.g., ethylene oxide, propylene oxide, butylene oxide) adducts on these bisphenols.

Among the preceding, alkylene glycols having 2 to 12 carbon atoms and alkylene oxide adducts on bisphenols are preferred, while alkylene oxide adducts on bisphenols and their combinations with alkylene glycols having 2 to 12 carbon atoms are particularly preferred.

At least trihydric alcohols can be exemplified by glycerol, trimethylolethane, trimethylolpropane, pentaerythritol, hexamethylolmelamine, hexaethylolmelamine, tetramethylolbenzoguanamine, tetraethylolbenzoguanamine, sorbitol, trisphenol PA, phenol novolac, cresol novolac, and alkylene oxide adducts on the preceding at least trihydric polyphenols. A single one of these may be used by itself or two or more may be used in combination.

The styrene-acrylic resin can be exemplified by homopolymers of the following polymerizable monomers, or copolymers obtained from a combination of two or more thereof, and by mixtures of the preceding:

styrene and styrenic monomers, e.g., α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, and p-phenylstyrene;

(meth)acrylic monomers such as methyl (meth)acrylate, ethyl (meth)acrylate, n-propyl (meth)acrylate, isopropyl (meth)acrylate, n-butyl (meth)acrylate, isobutyl (meth)acrylate, tert-butyl (meth)acrylate, n-amyl (meth)acrylate, n-hexyl (meth)acrylate, 2-ethylhexyl (meth)acrylate, n-octyl (meth)acrylate, n-nonyl (meth)acrylate, cyclohexyl (meth) acrylate, benzyl (meth)acrylate, dimethyl phosphate ethyl (meth)acrylate, diethyl phosphate ethyl (meth)acrylate, dibutyl phosphate ethyl (meth)acrylate, 2-benzoyloxyethyl (meth)acrylate, (meth)acrylonitrile, 2-hydroxyethyl (meth) acrylate, (meth)acrylic acid, and maleic acid;

vinyl ether monomers such as vinyl methyl ether and vinyl isobutyl ether; vinyl ketone monomers such as vinyl methyl ketone, vinyl ethyl ketone, and vinyl isopropenyl ketone; and olefins such as ethylene, propylene, and butadiene.

The styrene-acrylic resin may optionally use a multifunctional polymerizable monomer. The multifunctional polymerizable monomer can be exemplified by diethylene glycol di(meth)acrylate, triethylene glycol di(meth)acrylate, tetraethylene glycol di(meth)acrylate, polyethylene glycol di(meth)acrylate, 1,6-hexanediol di(meth)acrylate, neopentyl glycol di(meth)acrylate, tripropylene glycol di(meth) acrylate, polypropylene glycol di(meth)acrylate, 2,2'-bis(4-((meth)acryloxydiethoxy)phenyl)propane, trimethylolpropane tri(meth)acrylate, tetramethylolmethane tetra(meth)acrylate, divinylbenzene, divinylnaphthalene, and divinyl ether.

A known chain transfer agent and polymerization inhibitor may also be added in order to control the degree of polymerization.

The polymerization initiator used to obtain the styrene-acrylic resin can be exemplified by organoperoxide-type initiators and azo-type polymerization initiators.

The organoperoxide-type initiators can be exemplified by benzoyl peroxide, lauroyl peroxide, di-α-cumyl peroxide, 2,5-dimethyl-2,5-bis(benzoylperoxy)hexane, bis(4-t-butylcyclohexyl) peroxydicarbonate, 1,1-bis(t-butylperoxy)cyclododecane, t-butyl peroxymaleate, bis(t-butylperoxy) isophthalate, methyl ethyl ketone peroxide, tert-butyl peroxy-2-ethylhexanoate, diisopropyl peroxycarbonate, cumene hydroperoxide, 2,4-dichlorobenzoyl peroxide, and tert-butyl peroxypivalate.

The azo-type polymerization initiators are exemplified by 2,2'-azobis(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, azobismethylbutyronitrile, and 2,2'-azobis(methyl isobutyrate).

A redox initiator, comprising the combination of an oxidizing substance with a reducing substance, may also be used as the polymerization initiator.

The oxidizing substance can be exemplified by inorganic peroxides, e.g., hydrogen peroxide and persulfate salts (sodium salt, potassium salt, ammonium salt), and by oxidizing metal salts, e.g., salts of tetravalent cerium.

The reducing substance can be exemplified by reducing metal salts (divalent iron salts, monovalent copper salts, and trivalent chromium salts); ammonia; lower amines (amines having from 1 to about 6 carbon atoms, such as methylamine and ethylamine); amino compounds such as hydroxylamine; reducing sulfur compounds such as sodium thiosulfate, sodium hydrosulfite, sodium bisulfite, sodium sulfite, and sodium formaldehyde sulfoxylate; lower alcohols (from 1 to 6 carbon atoms); ascorbic acid and its salts; and lower aldehydes (from 1 to 6 carbon atoms).

The polymerization initiator is selected considering its 10-hour half-life decomposition temperature, and a single one or a mixture may be used. The amount of addition of the polymerization initiator will vary with the desired degree of polymerization, but generally from 0.5 mass parts to 20.0 mass parts is added per 100.0 mass parts of the polymerizable monomer.

Release Agent

The toner according to the present invention may use a known wax as a release agent.

Specific examples are petroleum waxes as represented by paraffin waxes, microcrystalline waxes, and petrolatum, and derivatives thereof; montan wax and derivatives thereof; hydrocarbon waxes provided by the Fischer-Tropsch method, and derivatives thereof; polyolefin waxes as represented by polyethylene, and derivatives thereof; and natural waxes as represented by carnauba wax and candelilla wax, and derivatives thereof. The derivatives include oxides and block copolymers and graft modifications with vinyl monomers.

Other examples are alcohols such as higher aliphatic alcohols; fatty acids such as stearic acid and palmitic acid, and their acid amides, esters, and ketones; hardened castor oil and derivatives thereof; plant waxes; and animal waxes. A single one of these or a combination thereof may be used.

Among the preceding, a trend of an enhanced developing performance and transferability is exhibited when a polyolefin, a hydrocarbon wax provided by the Fischer-Tropsch method, or a petroleum wax is used, which is thus preferred. An oxidation inhibitor may be added to these waxes in a range that does not influence the effects for the toner according to the present invention.

Higher fatty acid esters, e.g., behenyl behenate and dibehenyl sebacate, are favorable examples in terms of the crystallization temperature or the phase separation behavior with respect to the binder resin.

The content of the release agent is preferably from 1.0 mass parts to 30.0 mass parts per 100.0 mass parts of the binder resin.

The melting point of the release agent is preferably from 30° C. to 120° C. and more preferably from 60° C. to 100° C.

The use of a release agent exhibiting such a thermal behavior results in an efficient expression of the release effect and the provision of a broader fixing window.

Plasticizer

Preferably a crystalline plasticizer is used in the toner according to the present invention in order to enhance the sharp melt property. There are no particular limitations on the plasticizer, and the known plasticizers used in toners as indicated below may be used. In order to provide Ta−Tg≤35° C., a plasticizer with a molecular weight of not more than 1,500 is preferred and preferably a material is selected for which at least 8 mass parts is compatible with 100 mass parts of the binder resin. The selection of a material that satisfies the preceding formula (1) is particularly preferred.

Specific examples are esters between a monohydric alcohol and an aliphatic carboxylic acid and esters between a monobasic carboxylic acid and an aliphatic alcohol, such as behenyl behenate, stearyl stearate, and palmityl palmitate; esters between a dihydric alcohol and an aliphatic carboxylic acid and esters between a dibasic carboxylic acid and an aliphatic alcohol, such as ethylene glycol distearate, dibehenyl sebacate, and hexanediol dibehenate; esters between a trihydric alcohol and an aliphatic carboxylic acid and esters between a tribasic carboxylic acid and an aliphatic alcohol, such as glycerol tribehenate; esters between a tetrahydric alcohol and an aliphatic carboxylic acid and esters between a tetrabasic carboxylic acid and an aliphatic alcohol, such as pentaerythritol tetrastearate and pentaerythritol tetrapalmitate; esters between a hexahydric alcohol and an aliphatic carboxylic acid and esters between a hexabasic carboxylic acid and an aliphatic alcohol, such as dipentaerythritol hexastearate and dipentaerythritol hexapalmitate; esters between a polyhydric alcohol and an aliphatic carboxylic acid and esters between a polybasic carboxylic acid and an aliphatic alcohol, such as polyglycerol behenate; and natural ester waxes such as carnauba wax and rice wax. A single one or a combination of these may be used.

Among the preceding, ester compounds with the structures given in the following formulas (2) and (3) are particularly preferred from the standpoint of the balance between the development durability and low-temperature fixability. Ethylene glycol distearate is particularly preferred.

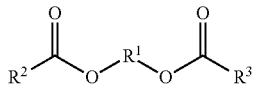
(2)

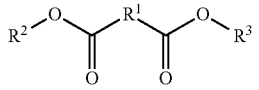
(3)

In formulas (2) and (3), $R^1$ represents an alkylene group having from 1 to 6 (preferably from 2 to 4) carbon atoms and $R^2$ and $R^3$ each independently represent a straight-chain alkyl group having from 11 to 25 (preferably from 16 to 22) carbon atoms.

The content of the plasticizer in the toner is preferably from 5 mass % to 30 mass % and is more preferably from 8 mass % to 20 mass %. The low-temperature fixability can co-exist with the development durability when the plasticizer content is in the indicated range.

Colorant

The toner particle may contain a colorant. Known pigments and dyes can be used as the colorant. Pigments are preferred for the colorant from the standpoint of providing an excellent weathering resistance.

Cyan colorants can be exemplified by copper phthalocyanine compounds and derivatives thereof, anthraquinone compounds, and basic dye lake compounds.

Specific examples are as follows: C. I. Pigment Blue 1, C. I. Pigment Blue 7, C. I. Pigment Blue 15, C. I. Pigment Blue 15:1, C. I. Pigment Blue 15:2, C. I. Pigment Blue 15:3, C. I. Pigment Blue 15:4, C. I. Pigment Blue 60, C. I. Pigment Blue 62, and C. I. Pigment Blue 66.

Magenta colorants can be exemplified by condensed azo compounds, diketopyrrolopyrrole compounds, anthraquinone compounds, quinacridone compounds, basic dye lake compounds, naphthol compounds, benzimidazolone compounds, thioindigo compounds, and perylene compounds.

Specific examples are as follows: C. I. Pigment Red 2, C. I. Pigment Red 3, C. I. Pigment Red 5, C. I. Pigment Red 6, C. I. Pigment Red 7, C. I. Pigment Red 19, C. I. Pigment Red 23, C. I. Pigment Red 48:2, C. I. Pigment Red 48:3, C. I. Pigment Red 48:4, C. I. Pigment Red 57:1, C. I. Pigment Red 81:1, C. I. Pigment Red 122, C. I. Pigment Red 144, C. I. Pigment Red 146, C. I. Pigment Red 150, C. I. Pigment Red 166, C. I. Pigment Red 169, C. I. Pigment Red 177, C. I. Pigment Red 184, C. I. Pigment Red 185, C. I. Pigment Red 202, C. I. Pigment Red 206, C. I. Pigment Red 220, C. I. Pigment Red 221, C. I. Pigment Red 254, and C. I. Pigment Violet 19.

Yellow colorants can be exemplified by condensed azo compounds, isoindolinone compounds, anthraquinone compounds, azo-metal complexes, methine compounds, and allylamide compounds.

Specific examples are as follows: C. I. Pigment Yellow 12, C. I. Pigment Yellow 13, C. I. Pigment Yellow 14, C. I. Pigment Yellow 15, C. I. Pigment Yellow 17, C. I. Pigment Yellow 62, C. I. Pigment Yellow 74, C. I. Pigment Yellow 83, C. I. Pigment Yellow 93, C. I. Pigment Yellow 94, C. I. Pigment Yellow 95, C. I. Pigment Yellow 97, C. I. Pigment Yellow 109, C. I. Pigment Yellow 110, C. I. Pigment Yellow 111, C. I. Pigment Yellow 120, C. I. Pigment Yellow 127, C. I. Pigment Yellow 128, C. I. Pigment Yellow 129, C. I. Pigment Yellow 147, C. I. Pigment Yellow 151, C. I. Pigment Yellow 154, C. I. Pigment Yellow 155, C. I. Pigment Yellow 168, C. I. Pigment Yellow 174, C. I. Pigment Yellow 175, C. I. Pigment Yellow 176, C. I. Pigment Yellow 180, C. I. Pigment Yellow 181, C. I. Pigment Yellow 185, C. I. Pigment Yellow 191, and C. I. Pigment Yellow 194.

Black colorants can be exemplified by carbon black and by black colorants provided by color mixing using the aforementioned yellow colorants, magenta colorants, and cyan colorants to give a black color.

A single one or a mixture of these colorants can be used, and these may also be used in the form of solid solutions.

The colorant is preferably used at from 1.0 mass parts to 20.0 mass parts per 100.0 mass parts of the binder resin.

Charge Control Agents and Charge Control Resins

The toner particle may contain a charge control agent or a charge control resin.

A known charge control agent can be used as the charge control agent, wherein a charge control agent that provides a fast triboelectric charging speed and that can maintain a defined and stable triboelectric charge quantity is particularly preferred. When the toner particle is produced by the suspension polymerization method, a charge control agent that exercises little polymerization inhibition and that is substantially free of material soluble in the aqueous medium is particularly preferred.

Charge control agents comprise charge control agents that control toner to negative charging and charge control agents that control toner to positive charging.

Charge control agents that control the toner to negative charging can be exemplified by monoazo metal compounds; acetylacetone-metal compounds; metal compounds of aromatic oxycarboxylic acids, aromatic dicarboxylic acids, oxycarboxylic acids, and dicarboxylic acids; aromatic oxycarboxylic acids, aromatic monocarboxylic acids, and aromatic polycarboxylic acids and their metal salts, anhydrides, and esters; phenol derivatives such as bisphenol; urea derivatives; metal-containing salicylic acid compounds; metal-containing naphthoic acid compounds; boron compounds; quaternary ammonium salts; calixarene; and charge control resins.

Charge control agents that control the toner to positive charging can be exemplified by the following:

guanidine compounds; imidazole compounds; quaternary ammonium salts such as tributylbenzylammonium 1-hydroxy-4-naphthosulfonate and tetrabutylammonium tetrafluoroborate, and their onium salt analogues, such as phosphonium salts, and their lake pigments; triphenylmethane dyes and their lake pigments (the laking agent is exemplified by phosphotungstic acid, phosphomolybdic acid, phosphomolybdotungstic acid, tannic acid, lauric acid, gallic acid, ferricyanides, and ferrocyanides); metal salts of higher fatty acids; and charge control resins.

Among these charge control agents, metal-containing salicylic acid compounds are preferred and metal-containing salicylic acid compounds in which the metal is aluminum or zirconium are particularly preferred.

The charge control resin can be exemplified by polymers and copolymers having a sulfonic acid group, sulfonate salt group, or sulfonate ester group. The polymer having a sulfonic acid group, sulfonate salt group, or sulfonate ester group is particularly preferably a polymer that contains at least 2 mass %, as the copolymerization ratio, of a sulfonic acid group-containing acrylamide-type monomer or sulfonic acid group-containing methacrylamide-type monomer, and more preferably is a polymer containing at least 5 mass % of same.

The charge control resin preferably has a glass transition temperature (Tg) from 35° C. to 90° C., a peak molecular weight (Mp) from 10,000 to 30,000, and a weight-average molecular weight (Mw) from 25,000 to 50,000. When this is used, preferred triboelectric charging characteristics can be conferred without exercising an influence on the thermal characteristics required of a toner particle. Moreover, because the charge control resin contains a sulfonic acid group, for example, the dispersibility of the charge control resin itself as well as the dispersibility of, e.g., the colorant, in the polymerizable monomer composition is improved and the tinting strength, transparency, and triboelectric charging characteristics can then be further improved.

A single one of these charge control agents or charge control resins may be added by itself, or a combination of two or more may be added.

The amount of addition of the charge control agent or charge control resin, per 100.0 mass parts of the binder resin, is preferably from 0.01 mass parts to 20.0 mass parts and is more preferably from 0.5 mass parts to 10.0 mass parts.

Carboxy Group-Containing Styrene Resin

The carboxy group-containing styrene resin preferably contains styrene and, as a copolymerization component, at least one selection from the group consisting of acrylic acid monomer and methacrylic acid monomer.

Other copolymerization components can be exemplified by acrylate esters and methacrylate esters and hydroxyalkyl acrylate esters and hydroxyalkyl methacrylate esters.

The carboxy group-containing styrene resin preferably is a polymer of monomer comprising styrene;

at least one selection from the group consisting of acrylic acid and methacrylic acid; and at least one selection from the group consisting of acrylate esters, methacrylate esters, hydroxyalkyl acrylate esters, and hydroxyalkyl methacrylate esters.

The carboxy group-containing styrene resin is more preferably a polymer of monomer comprising styrene;

at least one selection from the group consisting of acrylic acid and methacrylic acid; and at least one selection from the group consisting of methyl acrylate, methyl methacrylate, ethyl acrylate, ethyl methacrylate, propyl acrylate, propyl methacrylate, butyl acrylate, butyl methacrylate, octyl acrylate, octyl methacrylate, dodecyl acrylate, dodecyl methacrylate, stearyl acrylate, stearyl methacrylate, behenyl acrylate, behenyl methacrylate, 2-ethylhexyl acrylate, 2-ethylhexyl methacrylate, 2-hydroxyethyl acrylate, and 2-hydroxyethyl methacrylate.

A suitable value can be provided for the acid value of the carboxy group-containing styrene resin using the amount of the at least one selection from the group consisting of acrylic acid and methacrylic acid that is contained in the monomer composition for the carboxy group-containing styrene resin.

The weight-average molecular weight of the carboxy group-containing styrene resin is preferably 8,000 to 50,000.

The content of the carboxy group-containing styrene resin in the binder resin is preferably from 5 mass % to 30 mass %.

Organosilicon Polymer

The toner particle in the present invention preferably contains a surface layer that contains an organosilicon polymer. Polymer from an organosilicon compound having the structure given by the following formula (4) is an example of this organosilicon polymer.

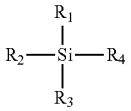

(4)

In formula (4), $R_1$ represents a hydrocarbon group (preferably an alkyl group) or aryl group having from 1 to 6 carbon atoms (preferably from 1 to 3 carbon atoms), and $R_2$, $R_3$, and $R_4$ each independently represent a halogen atom, hydroxy group, acetoxy group, or alkoxy group (preferably having from 1 to 4 carbon atoms).

The following are specific examples of formula (4):

methyltrimethoxysilane, methyltriethoxysilane, methyltrichlorosilane, ethyltrimethoxysilane, ethyltriethoxysilane, ethyltrichlorosilane, ethyltriacetoxysilane, propyltrimethoxysilane, propyltriethoxysilane, propyltrichlorosilane, butyltrimethoxysilane, butyltriethoxysilane, butyltrichlorosilane, butylmethoxydichlorosilane, butylethoxydichlorosilane, hexyltrimethoxysilane, hexyltriethoxysilane, phenyltrimethoxysilane, and phenyltriethoxysilane. A single one or a combination of these may be used.

The organosilicon polymer more preferably has a structure represented by the following formula (5).

$$R—SiO_{3/2} \quad (5)$$

Here, R represents a hydrocarbon group (preferably an alkyl group) or aryl group having from 1 to 6 (preferably from 1 to 3) carbon atoms.

The production method referred to as the sol-gel method is a typical example of a method for producing the organosilicon polymer.

It is known that the bonding status of the siloxane bonds that are produced generally varies in the sol-gel reaction as a function of the acidity of the reaction medium. Specifically, when the medium is acidic, the hydrogen ion electrophilically adds to the oxygen in one reactive group (for example, the alkoxy group (—OR group)). The oxygen atom in a water molecule then coordinates to the silicon atom and conversion into the hydrosilyl group occurs by a substitution reaction. Assuming enough water is present, since one oxygen atom of the reactive group (for example, the alkoxy group (—OR group)) is attacked by one $H^+$, the substitution reaction to give the hydroxy group will be slow when the $H^+$ content in the medium is low. The condensation polymerization reaction therefore occurs before all of the reactive groups bonded in the silane have been hydrolyzed and a one-dimensional chain polymer or a two-dimensional polymer is then produced relatively easily.

When, on the other hand, the medium is alkaline, the hydroxide ion adds to the silicon with passage through a pentacoordinate intermediate. Due to this, all of the reactive groups (for example, the alkoxy group (—OR group)) are readily eliminated and readily replaced by the silanol group. Particularly when a silicon compound is used that has three or more reactive groups in the same silane, hydrolysis and condensation polymerization proceed three dimensionally and an organosilicon polymer is formed that has abundant three dimensional crosslinking bonds. In addition, the reaction is also complete in a short period of time.

In addition, the sol-gel method starts out from a solution and forms a material by the gelation of this solution and as a consequence can provide a variety of microstructures and shapes. When, in particular, the toner particle is produced in an aqueous medium, inducing the presence on the toner particle surface is facilitated by the hydrophilicity generated by a hydrophilic group, e.g., the silanol group, in the organosilicon compound.

Accordingly, the sol-gel reaction for forming the organosilicon polymer is preferably carried out with the reaction medium in an alkaline condition, and in specific terms, when production is performed in an aqueous medium, preferably the pH is at least 8.0 and the reaction temperature is at least 50° C. and the reaction is run for a reaction time of at least 5 hours. Doing this supports the formation of an organosilicon polymer having a higher strength and an excellent durability.

Toner Production Methods

There are no particular limitations on the method of producing the toner particle, and known methods can be employed. The suspension polymerization method is preferred. That is, the toner particle is preferably a suspension polymerized toner particle.

In the suspension polymerization method, particles are formed, in an aqueous medium, of a polymerizable monomer composition containing the release agent and the polymerizable monomer that will produce the binder resin and optionally containing a plasticizer, colorant, organosilicon compound, and other additives, and toner particles are obtained by the polymerization of the polymerizable monomer contained in these particles of the polymerizable monomer composition.

In a first method here for forming a surface layer of an organosilicon polymer, an organosilicon compound is added to the polymerizable monomer composition. In the case of organosilicon compound addition, polymerization occurs in a state in which the organosilicon compound is precipitated in the vicinity of the toner particle surface and as a consequence an organosilicon polymer-containing surface layer can be formed on the toner particle. The use of this production method also facilitates the uniform precipitation of the organosilicon polymer.

In a second method, the surface layer of organosilicon polymer is formed in the aqueous medium after the core particle for the toner particle has been obtained. The toner particle core particle may be produced using, for example, a melt kneading pulverization method, an emulsion aggregation method, or a dissolution suspension method. The suspension polymerization method is preferred in terms of the uniformity of the organosilicon polymer-containing surface layer that is formed on the toner particle surface. The polymerizable monomer used for the styrene-acrylic resin described above in the section on the binder resin can be used for the polymerizable monomer in the suspension polymerization method.

The following method is preferred in the present invention for forming the surface layer of organosilicon polymer. First, a core particle for a toner containing binder resin and release agent is produced and is dispersed in an aqueous medium to obtain a core particle dispersion. With regard to the concentration at this point, preferably the core particle is dispersed at a concentration that provides a core particle solids fraction of from 10 mass % to 40 mass % with reference to the total amount of the core particle dispersion. The temperature of the core particle dispersion is preferably adjusted to 35° C. or higher before further processing.

The pH of the core particle dispersion is preferably adjusted to a pH that inhibits the development of condensation of the organosilicon compound. The pH at which organosilicon compound condensation is inhibited varies with the particular material and as a consequence within ±0.5 centered on the pH at which the reaction is most inhibited is preferred.

The use is preferred, on the other hand, of an organosilicon compound that has been subjected to a hydrolysis treatment. For example, hydrolysis may be carried out in advance in a separate vessel as a pretreatment for the organosilicon compound. The charge concentration for hydrolysis, using 100 mass parts for the amount of the organosilicon compound, is preferably from 40 mass parts to 500 mass parts and more preferably from 100 mass parts to 400 mass parts of water from which the ionic fraction has been removed, for example, deionized water or RO water. The conditions during hydrolysis are preferably a pH of 2 to 7, a temperature of 15° C. to 80° C., and a time of 30 minutes to 600 minutes.

By mixing the obtained hydrolysis solution and the core particle dispersion and adjusting to a pH suitable for condensation (preferably 1 to 3 or 6 to 12 and more preferably 8 to 12), a surface layer can be attached to the core particle surface of the toner while causing condensation of the organosilicon compound. Condensation and surface layer attachment are preferably carried out for at least 60 minutes at 35° C. or higher.

A time interval of holding at 35° C. or higher may be provided prior to adjusting to the pH suitable for condensation. This time interval is preferably from 3 minutes to 120 minutes viewed from the standpoint of adjusting the microstructure of the toner particle surface layer.

The aqueous medium used in the suspension polymerization method is exemplified by the following:

water; alcohols such as methanol, ethanol, and propanol; and mixed media of the preceding.

The known inorganic compound dispersion stabilizers and organic compound dispersion stabilizers can be used as the dispersion stabilizer used in the preparation of the aqueous medium.

The inorganic compound dispersion stabilizers can be exemplified by tricalcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, and alumina.

The following, on the other hand, are examples of organic compound dispersion stabilizers: polyvinyl alcohol, gelatin, methyl cellulose, methyl hydroxypropyl cellulose, ethyl cellulose, the sodium salt of carboxymethyl cellulose, polyacrylic acid and salts thereof, and starch.

These dispersion stabilizers are preferably used in an amount from 0.2 mass parts to 20.0 mass parts per 100 mass parts of the polymerizable monomer.

When, among these dispersion stabilizers, an inorganic compound dispersion stabilizer is used, a commercially available inorganic compound dispersion stabilizer may be directly used as such; however, the inorganic compound may be produced in the aqueous medium in order to obtain a dispersion stabilizer having an even finer particle diameter. For example, in the case of tricalcium phosphate, it is obtained by mixing an aqueous sodium phosphate solution with an aqueous calcium chloride solution under high speed stirring.

An external additive may be externally added to the obtained toner particle in order to impart various properties to the toner. External additives for bringing about an enhanced toner flowability can be exemplified by inorganic fine particles such as silica fine particles, titanium oxide fine particles, and composite oxide fine particles thereof. Silica fine particles and titanium oxide fine particles are preferred among the inorganic fine particles.

The silica fine particles can be exemplified by the dry silica and fumed silica produced by the vapor-phase oxidation of a silicon halide, and by the wet silica produced from water glass.

Dry silica is preferred for the inorganic fine particles because dry silica contains little of the silanol group present in the interior of silica fine particles and on the surface and contains little $Na_2O$ and $SO_3^{2-}$. The dry silica may be composite fine particles of silica and another metal oxide obtained by the use in the production process of a silicon halide compound in combination with another metal halide compound such as aluminum chloride or titanium chloride.

Through a hydrophobic treatment of the surface thereof with a treatment agent, the inorganic fine particles can bring about an adjustment of the triboelectric charge quantity on the toner, an improvement in the environmental stability, and an enhanced flowability in a high-temperature, high-humidity environment, and the use of hydrophobically treated inorganic fine particles is thus preferred.

The treatment agent for hydrophobically treating the inorganic fine particles can be exemplified by unmodified silicone varnishes, variously modified silicone varnishes, unmodified silicone oils, variously modified silicone oils, silicon compounds, silane coupling agents, other organosilicon compounds, and organotitanium compounds. Silicone oils are preferred among the preceding. A single one or a combination of these treatment agents may be used.

The total amount of inorganic fine particle addition, per 100 mass parts of the toner particle, is preferably from 1.00 mass parts to 5.00 mass parts and is more preferably from 1.00 mass parts to 2.50 mass parts. Viewed from the standpoint of toner durability, the external additive preferably has a particle diameter that is not more than one-tenth of the average particle diameter of the toner particle.

The methods used to measure the various properties in the present invention are described in the following.

Dynamic Viscoelastic Measurements on Toner

An "Ares" (TA Instruments) rotational plate rheometer is used as the measurement instrument. A sample provided by compression molding the toner in a 25° C. environment using a tablet molder into a cylindrical shape of diameter=7.9 mm and thickness=2.0±0.3 mm is used as the measurement sample.

This sample is installed in the parallel plates and the temperature is raised from room temperature (25° C.) to the viscoelastic measurement start temperature (50° C.) and measurement using the following conditions is started.

The measurement conditions are as follows.

(1) The sample is set to provide an initial normal force of 0.

(2) Parallel plates with a diameter of 7.9 mm are used.

(3) A frequency (Frequency) of 1.0 Hz is used.

(4) The initial value of the applied strain (Strain) is set to 0.1%.

(5) Measurement is carried out between 50° C. and 160° C. using a ramp rate (Ramp Rate) of 2.0° C./min and a sampling frequency of one time/° C. The measurement is performed using the following settings for automatic adjustment mode. The measurement is performed in automatic strain adjustment mode (Auto Strain).

(6) The maximum strain (Max Applied Strain) is set to 20.0%.

(7) The maximum torque (Max Allowed Torque) is set to 200.0 g·cm and the minimum torque (Min Allowed Torque) is set to 0.2 g·cm.

(8) The strain adjustment (Strain Adjustment) is set to 20.0% of Current Strain. Automatic tension adjustment mode (Auto Tension) is adopted for the measurement.

(9) The automatic tension direction (Auto Tension Direction) is set to compression (Compression).

(10) The initial static force (Initial Static Force) is set to 10.0 g and the automatic tension sensitivity (Auto Tension Sensitivity) is set to 40.0 g.

(11) For the automatic tension (Auto Tension) operating condition, the sample modulus (Sample Modulus) is equal to or greater than $1.0\times10^3$ (Pa).

The presence/absence of a minimum value for the storage elastic modulus (G') and Ta can be determined by this measurement.

Method for Calculating Solubility Parameter (SP Value)

The SP value for the present invention is determined using equation (A) according to Fedors. For the values of Δei and Δvi here, reference is made to "Energies of Vaporization and Molar Volumes (25° C.) of Atoms and Atomic Groups" in Tables 3 to 9 of "Basic Coating Science" (pp. 54-57, 1986 (Maki Shoten Publishing)). The unit for the SP value is $(cal/cm^3)^{1/2}$, but conversion to the $(J/m^3)^{1/2}$ unit can be carried out using 1 $(cal/cm^3)^{1/2}=2.046\times10^3$ $(J/m^3)^{1/2}$.

$$\delta i=[Ev/V]^{1/2}=[\Delta ei/\Delta vi]^{1/2} \quad \text{formula (A)}$$

Ev: energy of vaporization

V: molar volume

Δei: energy of vaporization of the atoms or atomic groups of component i

Δvi: molar volume of the atoms or atomic groups of component i

Method for Measuring Weight-Average Molecular Weight (Mw)

The weight-average molecular weight (Mw) of, e.g., the resin and plasticizer, is measured using gel permeation chromatography (GPC) as follows.

First, the sample is dissolved in tetrahydrofuran (THF) at room temperature. The obtained solution is filtered using a "Sample Pretreatment Cartridge" (Tosoh Corporation) solvent-resistant membrane filter having a pore diameter of 0.2 μm to obtain a sample solution. The sample solution is adjusted to a concentration of THF-soluble component of 0.8 mass %. Measurement is carried out under the following conditions using this sample solution.

instrument: "HLC-8220GPC" high-performance GPC instrument [Tosoh Corporation]

column: 2×LF-604 [Showa Denko Kabushiki Kaisha]

eluent: THF flow rate: 0.6 mL/min oven temperature: 40° C.

sample injection amount: 0.020 mL

A molecular weight calibration curve constructed using polystyrene resin standards (for example, product name "TSK Standard Polystyrene F-850, F-450, F-288, F-128, F-80, F-40, F-20, F-10, F-4, F-2, F-1, A-5000, A-2500, A-1000, A-500", Tosoh Corporation) is used to determine the molecular weight of the sample.

Method for Measuring Glass Transition Temperature (Tg)

The glass transition temperature (Tg) of the binder resin is measured using a "Q1000" differential scanning calorimeter (TA Instruments) in accordance with ASTM D 3418-82. Temperature correction in the instrument detection section is performed using the melting points of indium and zinc, and the amount of heat is corrected using the heat of fusion of indium.

Specifically, approximately 5 mg of the toner is exactly weighed out and this is introduced into an aluminum pan; an empty aluminum pan is used for reference. The measurement is run at a ramp rate of 1° C./min in the measurement temperature range from 30° C. to 200° C. The change in the specific heat is obtained during this heating process in the temperature range from 40° C. to 100° C. The glass transition temperature of the toner is taken to be the point at the intersection between the differential heat curve and the line for the midpoint for the baselines for prior to and subsequent to the appearance of the change in the specific heat in this process.

Measurement of Acid Value of Resin

The acid value of the resin in the present invention is measured in conformity with the method of JIS K 0070-1992 and specifically is measured in accordance with the following procedure.

1) Reagent Preparation

A phenolphthalein solution is obtained by dissolving 1.0 g of phenolphthalein in 90 mL of ethyl alcohol (95 volume %) and bringing to 100 mL by adding deionized water.

7 g of special-grade potassium hydroxide is dissolved in 5 mL of water and this is brought to 1 L by the addition of ethyl alcohol (95 volume %). This is introduced into an alkali-resistant container avoiding contact with, for example, carbon dioxide, and allowed to stand for 3 days. Standing is followed by filtration to obtain a potassium hydroxide solution. The obtained potassium hydroxide solution is stored in an alkali-resistant container.

The factor for this potassium hydroxide solution is determined from the amount of the potassium hydroxide solution required for neutralization when 25 mL of 0.1 mol/L hydrochloric acid is introduced into an Erlenmeyer flask, several drops of the aforementioned phenolphthalein solution are added, and titration is performed using the potassium hydroxide solution. The 0.1 mol/L hydrochloric acid is prepared in accordance with the method of JIS K 8001-1998.

2) Procedure (A) Main Test 2.0 g of the crushed measurement sample is exactly weighed into a 200-mL Erlenmeyer flask and 100 mL of a toluene/ethanol (2:1) mixed solution is added and dissolution is carried out over 5 hours. Several drops of the phenolphthalein solution are then added as indicator and titration is performed using the potassium hydroxide solution, and the titration endpoint is taken to be the persistence of the faint pink color of the indicator for approximately 30 seconds.

(B) Blank Test

The same titration as in the above procedure is run, but without using the sample (that is, with only the toluene/ethanol (2:1) mixed solution).

3) Calculation of the Acid Value

The acid value is calculated by substituting the obtained results into the following formula.

$$A=[(C-B)\times f\times 5.61]/S$$

Here, A: acid value (mg KOH/g); B: amount (mL) of addition of the potassium hydroxide solution in the blank test; C: amount (mL) of addition of the potassium hydroxide solution in the main test; f: factor for the potassium hydroxide solution; and S: mass of the sample (g).

Measurement of Weight-Average Particle Diameter (D4) and Number-Average Particle Diameter (D1) of Toner or Toner Particle The weight-average particle diameter (D4) and the number-average particle diameter (D1) of the toner or toner particle are determined by carrying out the measurements in 25,000 channels for the number of effective measurement channels and performing analysis of the measurement data using a "Coulter Counter Multisizer 3" (registered trademark, Beckman Coulter, Inc.), a precision particle size distribution measurement instrument operating on the pore electrical resistance method and equipped with a 100-μm aperture tube, and using the accompanying dedicated software, i.e., "Beckman Coulter Multisizer 3 Version 3.51" (Beckman Coulter, Inc.) to set the measurement conditions and analyze the measurement data.

The aqueous electrolyte solution used for the measurements is prepared by dissolving special-grade sodium chloride in deionized water to provide a concentration of approximately 1 mass % and, for example, "ISOTON II" (Beckman Coulter, Inc.) can be used.

The dedicated software is configured as follows prior to measurement and analysis.

In the "modify the standard operating method (SOM)" screen in the dedicated software, the total count number in the control mode is set to 50,000 particles; the number of measurements is set to 1 time; and the Kd value is set to the value obtained using "standard particle 10.0 μm" (Beckman Coulter, Inc.). The threshold value and noise level are automatically set by pressing the threshold value/noise level measurement button. In addition, the current is set to 1600 μA; the gain is set to 2; the electrolyte solution is set to ISOTON II; and a check is entered for the post-measurement aperture tube flush.

In the "setting conversion from pulses to particle diameter" screen of the dedicated software, the bin interval is set to logarithmic particle diameter; the particle diameter bin is set to 256 particle diameter bins; and the particle diameter range is set to from 2 μm to 60 μm.

The specific measurement procedure is as follows.

(1) Approximately 200 mL of the above-described aqueous electrolyte solution is introduced into a 250-mL roundbottom glass beaker intended for use with the Multisizer 3 and this is placed in the sample stand and counterclockwise stirring with the stirrer rod is carried out at 24 rotations per second. Contamination and air bubbles within the aperture tube are preliminarily removed by the "aperture tube flush" function of the dedicated software.

(2) Approximately 30 mL of the aqueous electrolyte solution is introduced into a 100-mL flatbottom glass beaker, and to this is added as dispersing agent approximately 0.3 mL of a dilution prepared by the three-fold (mass) dilution with deionized water of "Contaminon N" (a 10 mass % aqueous solution of a neutral pH 7 detergent for cleaning precision measurement instrumentation, comprising a nonionic surfactant, anionic surfactant, and organic builder, from Wako Pure Chemical Industries, Ltd.).

(3) A prescribed amount of deionized water is introduced into the water tank of an "Ultrasonic Dispersion System Tetora 150" (Nikkaki Bios Co., Ltd.), an ultrasound disperser having an electrical output of 120 W and equipped with two oscillators (oscillation frequency=50 kHz) disposed such that the phases are displaced by 180°, and approximately 2 mL of Contaminon N is added to the water tank.

(4) The beaker described in (2) is set into the beaker holder opening on the ultrasound disperser and the ultrasound disperser is started. The vertical position of the beaker is adjusted in such a manner that the resonance condition of the surface of the aqueous electrolyte solution within the beaker is at a maximum.

(5) While the aqueous electrolyte solution within the beaker set up according to (4) is being irradiated with ultrasound, approximately 10 mg of the toner or toner particle is added to the aqueous electrolyte solution in small aliquots and dispersion is carried out. The ultrasound dispersion treatment is continued for an additional 60 seconds. The water temperature in the water tank is controlled as appropriate during ultrasound dispersion to be from 10° C. to 40° C.

(6) Using a pipette, the dispersed toner- or toner particle-containing aqueous electrolyte solution prepared in (5) is dripped into the roundbottom beaker set in the sample stand as described in (1) with adjustment to provide a measurement concentration of approximately 5%. Measurement is then performed until the number of measured particles reaches 50,000.

(7) The measurement data is analyzed by the previously cited dedicated software provided with the instrument and the weight-average particle diameter (D4) is calculated. When set to graph/volume % with the dedicated software, the "average diameter" on the analysis/volumetric statistical value (arithmetic average) screen is the weight-average particle diameter (D4), and when set to graph/number % with the dedicated software, the "average diameter" on the "analysis/numerical statistical value (arithmetic average)" screen is the number-average particle diameter (D1).

Measurement of Content in Toner of Plasticizer (Ester Compound) Given by Formula (2) or (3)

The content in the toner of the plasticizer (ester compound) given by formula (2) or (3) is measured using nuclear magnetic resonance spectroscopy ($^1$H-NMR) [400 MHz, $CDCl_3$, room temperature (25° C.)].

measurement instrument: JNM-EX400 FT-NMR instrument (JEOL Ltd.)
measurement frequency: 400 MHz
pulse condition: 5.0 μs
frequency range: 10,500 Hz
number of scans: 64

The amount of plasticizer in the toner is determined from the integrated values for the spectrum of the plasticizer as such and the integrated values for the spectrum of the plasticizer in the toner spectrum.

EXAMPLES

The present invention is more specifically described in the following using examples. The present invention is not limited by the examples that follow. The "parts" in the text are on a mass basis unless specifically indicated otherwise.

Carboxy Group-Containing Styrene Resin 1 Production Example 300 parts of xylene was introduced into a flask, thorough substitution of the interior of the vessel was carried out while stirring, and reflux was established by heating.

| | |
|---|---|
| styrene | 92.53 parts |
| methyl methacrylate | 2.50 parts |
| 2-hydroxyethyl methacrylate | 2.50 parts |
| methacrylic acid | 2.48 parts |
| Perbutyl D (NOF Corporation) | 2.00 parts |

This mixture was added followed by running a polymerization for 5 hours using a polymerization temperature of 175° C. and a pressure of 0.10 MPa. This was followed by lowering the pressure and performing a solvent removal process for 3 hours to remove the xylene; pulverization then provided a carboxy group-containing styrene resin 1. The obtained carboxy group-containing styrene resin 1 had a weight-average molecular weight (Mw)=15,000 and an acid value=15 mg KOH/g.

Carboxy Group-Containing Styrene Resin 2 Production Example

Carboxy group-containing styrene resin 2 was obtained by carrying out production as for carboxy group-containing styrene resin 1 in the Carboxy Group-Containing Styrene Resin 1 Production Example, but using the formulation list given below and changing the pressure during the polymerization to 0.50 MPa. The obtained carboxy group-containing styrene resin 2 had a weight-average molecular weight (Mw)=14,000 and an acid value=5 mg KOH/g.

| | |
|---|---|
| styrene | 91.68 parts |
| methyl methacrylate | 2.50 parts |
| 2-hydroxyethyl methacrylate | 5.00 parts |
| methacrylic acid | 0.83 parts |
| Perbutyl D (NOF Corporation) | 2.00 parts |

Carboxy Group-Containing Styrene Resin 3 Production Example

Carboxy group-containing styrene resin 3 was obtained by carrying out production as for carboxy group-containing styrene resin 1 in the Carboxy Group-Containing Styrene Resin 1 Production Example, but using the formulation list given below and changing the pressure during the polymerization to 0.50 MPa. The obtained carboxy group-containing styrene resin 3 had a weight-average molecular weight (Mw)=15,000 and an acid value=25 mg KOH/g.

| | |
|---|---|
| styrene | 91.30 parts |
| methyl methacrylate | 2.50 parts |
| 2-hydroxyethyl methacrylate | 1.25 parts |
| methacrylic acid | 3.97 parts |
| Perbutyl D (NOF Corporation) | 2.00 parts |

Carboxy Group-Containing Styrene Resin 4 Production Example

Carboxy group-containing styrene resin 4 was obtained by carrying out production as for carboxy group-containing styrene resin 1 in the Carboxy Group-Containing Styrene Resin 1 Production Example, but using the formulation list given below and changing the pressure during the polymerization to 0.50 MPa. The obtained carboxy group-containing styrene resin 4 had a weight-average molecular weight (Mw)=16,000 and an acid value=30 mg KOH/g.

| | |
|---|---|
| styrene | 91.30 parts |
| methyl methacrylate | 2.50 parts |
| 2-hydroxyethyl methacrylate | 1.25 parts |

-continued

| | |
|---|---|
| methacrylic acid | 4.95 parts |
| Perbutyl D (NOF Corporation) | 2.00 parts |

Polyester Resin 1 Production Example

The following polyester monomers were introduced into an autoclave equipped with a pressure reduction apparatus, a water separation apparatus, a nitrogen gas introduction apparatus, a temperature measurement apparatus, and a stirring apparatus:

| | |
|---|---|
| terephthalic acid | 21.0 parts |
| isophthalic acid | 21.0 parts |
| 2 mol propylene oxide adduct on bisphenol A | 89.5 parts |
| 3 mol propylene oxide adduct on bisphenol A | 23.0 parts |
| potassium titanium oxalate | 0.030 parts |

and a reaction was run for 15 hours at 220° C. under normal pressure in a nitrogen atmosphere. A reaction was further run for 1 hour at a vacuum of 10 to 20 mmHg to obtain polyester resin 1. Polyester resin 1 had a glass transition temperature (Tg) of 74.8° C. and an acid value of 8.2 mg KOH/g.

Polyester Resin 2 Production Example

| | |
|---|---|
| terephthalic acid | 100.0 parts |
| 2 mol propylene oxide adduct on bisphenol A | 205.0 parts |

These monomers were introduced into an autoclave together with an esterification catalyst and the autoclave was equipped with a pressure reduction apparatus, a water separation apparatus, a nitrogen gas introduction apparatus, a temperature measurement apparatus, and a stirring apparatus. While reducing the pressure in a nitrogen atmosphere, a reaction was then run at 210° C. by an ordinary method until the Tg reached 68.0° C. to give polyester resin 2. Polyester resin 2 had a weight-average molecular weight (Mw) of 7,500 and a number-average molecular weight (Mn) of 3,000.

Polyester Resin 3 Production Example

| | |
|---|---|
| 2 mol ethylene oxide adduct on bisphenol A | 725.0 parts |
| phthalic acid | 290.0 parts |
| dibutyltin oxide | 3.0 parts |

These materials were reacted for 7 hours at 220° C. while stirring and were reacted for an additional 5 hours under reduced pressure. This was followed by cooling to 80° C. and reaction for 2 hours with 190.0 parts of isophorone diisocyanate in ethyl acetate to obtain an isocyanate group-bearing polyester resin. 25.0 parts of this isocyanate group-bearing polyester resin and 1.0 parts of isophoronediamine were reacted for 2 hours at 50° C. to obtain a polyester resin 3, in which the major component was a urea group-containing polyester.

The obtained polyester resin 3 had a weight-average molecular weight (Mw) of 22,200, a number-average molecular weight (Mn) of 2,900, and a peak molecular weight of 7,300.

Toner 1 Production Example 60.0 parts of deionized water was metered into a reactor equipped with a stirrer and thermometer and the pH was adjusted to 3.0 using 10 mass % hydrochloric acid. This was heated while being stirred to bring the temperature to 70° C. 40.0 parts of methyltriethoxysilane, an organosilicon compound for the surface layer, was then added and a hydrolysis was carried out for at least 2 hours while stirring. The end point of the hydrolysis was confirmed by visual observation when oil/water separation was not occurring and a single layer had been assumed; cooling then yielded a hydrolysis solution of the organosilicon compound for the surface layer.

700 parts of deionized water, 1,000 parts of a 0.1 mol/liter aqueous solution of $Na_3PO_4$, and 24.0 parts of a 1.0 mol/liter aqueous HCl solution were then introduced into a four-neck vessel equipped with a reflux condenser, a stirrer, a thermometer, and a nitrogen introduction line and holding at 60° C. was performed while stirring at 12,000 rpm using a T. K. Homomixer (Tokushu Kika Kogyo Co., Ltd.) high-speed stirrer. To this was gradually added 85 parts of a 1.0 mol/liter aqueous solution of $CaCl_2$ to produce an aqueous dispersion that contained the microfine, sparingly water-soluble dispersion stabilizer $Ca_3(PO_4)_2$.

| | |
|---|---|
| styrene monomer | 75.0 parts |
| n-butyl acrylate | 25.0 parts |
| carboxy group-containing styrene resin 1 | 6.0 parts |
| hexanediol diacrylate | 0.5 parts |
| copper phthalocyanine pigment (Pigment Blue 15:3) | 6.5 parts |
| polyester resin 1 | 5.0 parts |
| charge control agent, Bontron E-88 (Orient Chemical Industries Co., Ltd.) | 0.7 parts |
| release agent (hydrocarbon wax, melting point: 79° C.) | 5.0 parts |
| plasticizer (ethylene glycol distearate) | 15.0 parts |

These materials were dispersed for 3 hours using an attritor (Mitsui Miike Chemical Engineering Machinery Co., Ltd.) and the resulting polymerizable monomer composition was held for 20 minutes at 60° C. This was followed by the addition of 12.0 parts (40% toluene solution) of the polymerization initiator t-butyl peroxypivalate to the polymerizable monomer composition, and the resulting polymerizable monomer composition was introduced into the aqueous medium and granulation was performed for 10 minutes while holding the stirring rate of the high-speed stirrer at 12,000 rpm.

The high-speed stirrer was then changed over to an impeller stirrer and the internal temperature was raised to 70° C. and a reaction was run for 5 hours while gently stirring to yield toner core particle 1. The pH of the aqueous medium at this time was 5.1.

The internal temperature was then brought to 55° C. and 20.0 parts of the hydrolysis solution of the organosilicon compound for the surface layer was added and formation of the toner surface layer was started. Holding in the indicated condition was performed for 30 minutes; then, using an aqueous sodium hydroxide solution, the slurry was adjusted to pH=9.0 for completion of the condensation; and holding was carried out for an additional 300 minutes to form the surface layer. After cooling to 30° C., the dispersion stabilizer was removed by the addition of 10% hydrochloric acid. Filtration, washing, and drying then gave a toner particle 1 having a weight-average particle diameter of 5.8 μm. The obtained toner particle 1 was used as toner 1.

The formulation and conditions for toner 1 are given in Table 1, while the properties are given in Table 2.

Toners 2 to 10 Production Example

Toners 2 to 10 were obtained using the same method as for toner 1, but changing to the formulations and conditions given in Table 1. The formulations and conditions for toners 2 to 10 are given in Table 1, while the properties are given in Table 2.

Toner 11 Production Example

| | |
|---|---|
| polyester resin 2 | 60.0 parts |
| polyester resin 3 | 40.0 parts |
| copper phthalocyanine pigment (Pigment Blue 15:3) | 6.5 parts |
| charge control agent, Bontron E-88 (Orient Chemical Industries Co., Ltd.) | 0.7 parts |
| release agent (hydrocarbon wax, melting point: 79° C.) | 5.0 parts |
| plasticizer (ethylene glycol distearate) | 15.0 parts |

These materials were dissolved in 400 parts of toluene to yield a solution.

700 parts of deionized water, 1,000 parts of a 0.1 mol/liter aqueous solution of $Na_3PO_4$, and 24.0 parts of a 1.0 mol/liter aqueous HCl solution were then introduced into a four-neck vessel equipped with a Liebig reflux condenser, and holding at 60° C. was performed while stirring at 12,000 rpm using a T. K. Homomixer (Tokushu Kika Kogyo Co., Ltd.) high-speed stirrer. To this was gradually added 85 parts of a 1.0 mol/liter aqueous solution of $CaCl_2$ to produce an aqueous dispersion that contained the microfine, sparingly water-soluble dispersion stabilizer $Ca_3(PO_4)_2$.

100 parts of the aforementioned solution was then introduced while stirring at 12,000 rpm using a T. K. Homomixer (Tokushu Kika Kogyo Co., Ltd.), and stirring was performed for 5 minutes. The resulting mixture was then held for 5 hours at 70° C. The pH was 5.1.

The internal temperature was then brought to 55° C. and 20.0 parts of the hydrolysis solution of the organosilicon compound for the surface layer was added and formation of the toner surface layer was started. Holding in the indicated condition was performed for 30 minutes; then, using an aqueous sodium hydroxide solution, the slurry was adjusted to pH=9.0 for completion of the condensation; and holding was carried out for an additional 300 minutes to form the surface layer. After cooling to 30° C., the dispersion stabilizer was removed by the addition of 10% hydrochloric acid. Filtration, washing, and drying then gave a toner particle 11. The obtained toner particle 11 was used as toner 11.

The properties of toner 11 are given in Table 2.

Toner 12 Production Example

| | |
|---|---|
| polyester resin 2 | 60.0 parts |
| polyester resin 3 | 40.0 parts |
| copper phthalocyanine pigment (Pigment Blue 15:3) | 6.5 parts |
| charge control agent, Bontron E-88 (Orient Chemical Industries Co., Ltd.) | 0.7 parts |
| release agent (hydrocarbon wax, melting point: 79° C.) | 5.0 parts |
| plasticizer (ethylene glycol distearate) | 15.0 parts |

These materials were mixed using a Mitsui Henschel mixer (Mitsui Miike Chemical Engineering Machinery Co., Ltd.) followed by melt-kneading at 135° C. using a twin-screw kneading extruder. The kneaded material was cooled followed by crude pulverization using a cutter mill and pulverization using a jet air current-based micropulverizer. Classification was carried out using a wind force classifier to yield a toner core having a weight-average particle diameter of 5.8 μm.

700 parts of deionized water, 1,000 parts of a 0.1 mol/liter aqueous solution of $Na_3PO_4$, and 24.0 parts of a 1.0 mol/liter aqueous HCl solution were then introduced into a four-neck vessel equipped with a Liebig reflux condenser and holding at 60° C. was performed while stirring at 12,000 rpm using a T. K. Homomixer (Tokushu Kika Kogyo Co., Ltd.) high-speed stirrer. To this was gradually added 85 parts of a 1.0 mol/liter aqueous solution of $CaCl_2$ to produce an aqueous dispersion medium that contained the microfine, sparingly water-soluble dispersion stabilizer $Ca_3(PO_4)_2$.

The internal temperature was then brought to 55° C. and 20.0 parts of the hydrolysis solution of the organosilicon compound for the surface layer was added and formation of the toner surface layer was started. Holding in the indicated condition was performed for 30 minutes; then, using an aqueous sodium hydroxide solution, the slurry was adjusted to pH=9.0 for completion of the condensation; and holding was carried out for an additional 300 minutes to form the surface layer. After cooling to 30° C., the dispersion stabilizer was removed by the addition of 10% hydrochloric acid. Filtration, washing, and drying then gave a toner particle 12. The obtained toner particle 12 was used as toner 12.

The properties of toner 12 are given in Table 2.

Toner 13 Production Example

Synthesis of Polyester Resin 4

| | |
|---|---|
| 2 mol ethylene oxide adduct on bisphenol A | 9 mol parts |
| 2 mol propylene oxide adduct on bisphenol A | 95 mol parts |
| terephthalic acid | 50 mol parts |
| fumaric acid | 30 mol parts |
| dodecenylsuccinic acid | 25 mol parts |

These monomers were introduced into a flask equipped with a stirring apparatus, a nitrogen introduction line, a temperature sensor, and a rectification column, and the temperature was raised to 195° C. in 1 hour and it was confirmed that the interior of the reaction system was being uniformly stirred. 1.0 part of tin distearate was introduced per 100 parts of these monomers. The temperature was raised from 195° C. to 250° C. over 5 hours while distilling out the produced water, and the dehydration condensation reaction was run for an additional 2 hours at 250° C.

This resulted in the production of an amorphous polyester resin 4, which had a glass transition temperature of 60.2° C., an acid value of 13.8 mg KOH/g, a hydroxyl value of 28.2 mg KOH/g, a weight-average molecular weight of 14,200, a number-average molecular weight of 4,100, and a softening point of 111° C.

Synthesis of Polyester Resin 5

| | |
|---|---|
| 2 mol ethylene oxide adduct on bisphenol A | 48 mol parts |
| 2 mol propylene oxide adduct on bisphenol A | 48 mol parts |
| terephthalic acid | 65 mol parts |
| dodecenylsuccinic acid | 30 mol parts |

These monomers were introduced into a flask equipped with a stirring apparatus, a nitrogen introduction line, a temperature sensor, and a rectification column, and the temperature was raised to 195° C. in 1 hour and it was confirmed that the interior of the reaction system was being uniformly stirred. 0.7 parts of tin distearate was introduced per 100 parts of these monomers. The temperature was raised from 195° C. to 240° C. over 5 hours while distilling out the produced water, and the dehydration condensation reaction was run for an additional 2 hours at 240° C. The temperature was then lowered to 190° C. and 5 mol parts of trimellitic anhydride was gradually introduced and the reaction was continued for 1 hour at 190° C.

This resulted in the production of a polyester resin 5, which had a glass transition temperature of 55.2° C., an acid value of 14.3 mg KOH/g, a hydroxyl value of 24.1 mg KOH/g, a weight-average molecular weight of 53,600, a number-average molecular weight of 6,000, and a softening point of 108° C.

Resin Particle Dispersion 1 Preparation

| | |
|---|---|
| polyester resin 4 | 100 parts |
| methyl ethyl ketone | 50 parts |
| isopropyl alcohol | 20 parts |

The methyl ethyl ketone and isopropyl alcohol were introduced into a vessel. This was followed by the gradual introduction of the resin with stirring to bring about complete dissolution to yield a polyester resin 4 solution. The vessel containing this polyester resin 4 solution was set to 65° C.; a 10% aqueous ammonia solution was gradually added dropwise while stirring to provide a total of 5 parts; and 230 parts of deionized water was gradually added dropwise at a rate of 10 mL/min to cause phase inversion emulsification. The solvent was removed under reduced pressure using an evaporator to give a resin particle dispersion 1 of polyester resin 4. The volume-average particle diameter of the resin particles was 135 nm. The amount of the resin particle solids fraction was brought to 20% by adjustment with deionized water.

Resin Particle Dispersion 2 Preparation

| | |
|---|---|
| polyester resin 5 | 100 parts |
| methyl ethyl ketone | 50 parts |
| isopropyl alcohol | 20 parts |

The methyl ethyl ketone and isopropyl alcohol were introduced into a vessel. This was followed by the gradual introduction of the material indicated above with stirring to bring about complete dissolution to yield a polyester resin 5 solution. The vessel containing this polyester resin 5 solution was set to 40° C.; a 10% aqueous ammonia solution was gradually added dropwise while stirring to provide a total of 3.5 parts; and 230 parts of deionized water was gradually added dropwise at a rate of 10 mL/min to cause phase inversion emulsification. The solvent was removed under reduced pressure to give a resin particle dispersion 2 of polyester resin 5. The volume-average particle diameter of the resin particles was 155 nm. The amount of the resin particle solids fraction was brought to 20% by adjustment with deionized water.

Colorant Particle Dispersion Preparation

| | |
|---|---|
| copper phthalocyanine (Pigment Blue 15:3) | 45 parts |
| Neogen RK ionic surfactant (Dai-ichi Kogyo Seiyaku Co., Ltd.) | 5 parts |
| deionized water | 190 parts |

These components were mixed and were dispersed for 10 minutes using a homogenizer (Ultra-Turrax, IKA). This was followed by a dispersion treatment for 20 minutes at a pressure of 250 MPa using an Ultimizer (a countercollision wet pulverizer, Sugino Machine Limited) to obtain a colorant particle dispersion having a solids fraction of 20% and a volume-average particle diameter for the colorant particles of 120 nm.

Release Agent Particle Dispersion Preparation

| | |
|---|---|
| release agent (hydrocarbon wax, melting point: 79° C.) | 15.0 parts |
| plasticizer (ethylene glycol distearate) | 45.0 parts |
| Neogen RK ionic surfactant (Dai-ichi Kogyo Seiyaku Co., Ltd.) | 2 parts |
| deionized water | 240 parts |

The preceding was heated to 100° C. and was thoroughly dispersed using an Ultra-Turrax T50 from IKA. This was followed by heating to 115° C. and a 1-hour dispersion treatment using a Gaulin pressure ejection homogenizer to give a release agent particle dispersion having a solids fraction of 20% and a volume-average particle diameter of 160 nm.

Toner Particle 13 Production

| | |
|---|---|
| resin particle dispersion 1 | 500 parts |
| resin particle dispersion 2 | 400 parts |
| colorant particle dispersion | 50 parts |
| release agent particle dispersion | 165 parts |

2.2 parts Neogen RK ionic surfactant was added to a flask and the preceding materials were then stirred. The pH was subsequently brought to 3.7 by the dropwise addition of a 1 mol/L aqueous nitric acid solution; 0.35 parts of polyaluminum sulfate was added to this; and dispersion was performed using an Ultra-Turrax from IKA. Heating to 55° C. was carried out on a heating oil bath while stirring the flask. Holding was performed for 40 minutes at 55° C.

With the internal temperature remaining at 55° C., 20.0 parts of the hydrolysis solution of the organosilicon compound for the surface layer was then added and formation of the toner surface layer was started. Holding in the indicated condition was performed for 30 minutes; then, using an aqueous sodium hydroxide solution, the slurry was adjusted to pH=9.0 for completion of the condensation; and holding was carried out for an additional 300 minutes to form the surface layer. After cooling to 30° C., filtration, washing, and drying then gave a toner particle 13. The obtained toner particle 13 was used as toner 13.

The properties of toner 13 are given in Table 2.

Comparative Toner 1 Production Example

A comparative toner 1 was obtained by mixing the following with 100 parts of the toner core particle 1 using a Mitsui Henschel mixer (Mitsui Miike Chemical Engineering Machinery Co., Ltd.): 1.80 parts of a hydrophobic silica having a specific surface area by the BET method of 90 $m^2/g$ and having a surface hydrophobically treated with 3.0 mass % hexamethyldisilazane and 3 mass % 100-cps silicone oil. The properties of comparative toner 1 are given in Table 2.

Comparative Toner 2 Production Example

A comparative toner core particle 2 was obtained proceeding as in the production of toner core particle 1, but changing the 0.5 parts of hexanediol diacrylate to 1.0 part. A comparative toner 2 was obtained by mixing the following with 100 parts of the comparative toner core particle 2 using a Mitsui Henschel mixer (Mitsui Miike Chemical Engineering Machinery Co., Ltd.): 1.80 parts of a hydrophobic silica having a specific surface area by the BET method of 90 $m^2/g$ and having a surface hydrophobically treated with 3.0 mass % hexamethyldisilazane and 3 mass % 100-cps silicone oil. The properties of comparative toner 2 are given in Table 2.

Comparative Toner 3 Production Example

Synthesis of Polyurethane Resin 1

| | |
|---|---|
| Uniol DA-400 (NOF Corporation) | 60.8 parts |
| dimethylolbutanoic acid | 2.5 parts |
| diphenylmethane-4,4'-diisocyanate | 38.5 parts |
| dioctyltin dilaurate | 0.02 parts |

These monomers were introduced into a flask equipped with a stirring apparatus, nitrogen introduction line, temperature sensor, and rectification column, and a reaction was run for 5 hours at 130° C. to give a polyurethane resin 1. Polyurethane resin 1 had a weight-average molecular weight (Mw) of 38,000 and a Tg of 76° C.

| | |
|---|---|
| polyurethane resin 1 | 100 parts |
| copper phthalocyanine (Pigment Blue 15:3) | 6.5 parts |

These materials were mixed using a Mitsui Henschel mixer (Mitsui Miike Chemical Engineering Machinery Co., Ltd.) followed by melt-kneading at 135° C. using a twin-screw kneading extruder. The kneaded material was cooled followed by crude pulverization using a cutter mill and pulverization using a jet air current-based micropulverizer. Classification was carried out using a wind force classifier to yield a comparative toner core particle 3.

A comparative toner 3 was obtained by mixing the following with 100 parts of the comparative toner core particle 3 using a Mitsui Henschel mixer (Mitsui Miike Chemical Engineering Machinery Co., Ltd.): 1.80 parts of a hydrophobic silica having a specific surface area by the BET method of 90 $m^2/g$ and having a surface hydrophobically treated with 3.0 mass % hexamethyldisilazane and 3 mass % 100-cps silicone oil. The properties of comparative toner 3 are given in Table 2.

TABLE 1

| | | Toner No. | | | | | | | | | |
|---|---|---|---|---|---|---|---|---|---|---|---|
| | | 1 | 2 | 3 | 4 | 5 | 6 | 7 | 8 | 9 | 10 |
| Polymerizable monomer | Styrene | 75.0 | 75.0 | 75.0 | 75.0 | 75.0 | 75.0 | 75.0 | 75.0 | 75.0 | 75.0 |
| | n-butyl acrylate | 25.0 | 25.0 | 25.0 | 25.0 | 25.0 | 25.0 | 25.0 | 25.0 | 25.0 | 25.0 |
| | Hexanediol diacrylate | 0.5 | 0.5 | 0.5 | 0.5 | 0.5 | 0.5 | 0.5 | 0.5 | 0.5 | 0.5 |
| Organosilicon compound | Hydrolysis solution of methyltriethoxysilane | 20.0 | 25.0 | 20.0 | 15.0 | 20.0 | 20.0 | 20.0 | 20.0 | 20.0 | 20.0 |
| Resin | Polyester resin 1 | 5.0 | 5.0 | 5.0 | 5.0 | 5.0 | 5.0 | 5.0 | 5.0 | 5.0 | 5.0 |
| | Carboxy group-containing styrene resin 1 | 6.0 | 6.0 | 6.0 | 6.0 | 6.0 | 6.0 | 0 | 0 | 0 | 0 |
| | Carboxy group-containing styrene resin 2 | 0 | 0 | 0 | 0 | 0 | 0 | 6.0 | 0 | 0 | 0 |

TABLE 1-continued

| | | Toner No. | | | | | | | | | |
|---|---|---|---|---|---|---|---|---|---|---|---|
| | | 1 | 2 | 3 | 4 | 5 | 6 | 7 | 8 | 9 | 10 |
| | Carboxy group-containing styrene resin 3 | 0 | 0 | 0 | 0 | 0 | 0 | 0 | 6.0 | 0 | 0 |
| | Carboxy group-containing styrene resin 4 | 0 | 0 | 0 | 0 | 0 | 0 | 0 | 0 | 0 | 6.0 |
| Release agent | Hydrocarbon wax (melting point 79° C.) | 5.0 | 5.0 | 5.0 | 5.0 | 5.0 | 5.0 | 5.0 | 5.0 | 5.0 | 5.0 |
| Plasticizer | Formula (2) $R^1$: —$(CH_2)_2$— $R^2$ and $R^3$: $C_{17}H_{35}$— | 15.0 | 30.0 | 12.0 | 8.0 | 12.0 | 20.0 | 0 | 0 | 15.0 | 15.0 |
| | Formula (2) $R^1$: —$(CH_2)_6$— $R^2$ and $R^3$: $C_{11}H_{23}$— | 0 | 0 | 0 | 0 | 0 | 0 | 15.0 | 0 | 0 | 0 |
| | Formula (3) $R^1$: —$(CH_2)_2$— $R^2$ and $R^3$: $C_{25}H_{51}$— | 0 | 0 | 0 | 0 | 0 | 0 | 0 | 15.0 | 0 | 0 |
| Charge control agent | Bontron E-88 | 0.7 | 0.7 | 0.7 | 0.7 | 0.7 | 0.7 | 0.7 | 0.7 | 0.7 | 0.7 |
| Colorant | Pigment Blue 15:3 | 6.5 | 6.5 | 6.5 | 6.5 | 6.5 | 6.5 | 6.5 | 6.5 | 6.5 | 6.5 |
| Polymerization initiator | t-butyl peroxypivalate | 12.0 | 12.0 | 12.0 | 12.0 | 12.0 | 12.0 | 12.0 | 12.0 | 12.0 | 12.0 |

The numerical values for the starting materials in the table indicate the number of parts.

TABLE 2

| | Toner No. | | | | | | | | | | | | | | | |
|---|---|---|---|---|---|---|---|---|---|---|---|---|---|---|---|---|
| | | | | | | | | | | | | | | Comparative | | |
| | 1 | 2 | 3 | 4 | 5 | 6 | 7 | 8 | 9 | 10 | 11 | 12 | 13 | 1 | 2 | 3 |
| D4 | 5.8 | 5.7 | 5.5 | 5.6 | 5.8 | 5.5 | 5.8 | 5.7 | 5.8 | 5.8 | 5.7 | 5.7 | 5.8 | 5.5 | 5.8 | 5.8 |
| D1 | 5.4 | 5.3 | 5.2 | 5.3 | 5.3 | 5.2 | 5.2 | 5.2 | 5.3 | 5.2 | 5.2 | 5.2 | 5.3 | 5.1 | 5.3 | 5.3 |
| Tg | 55 | 57 | 54 | 55 | 40 | 70 | 55 | 55 | 55 | 55 | 55 | 55 | 55 | 55 | 55 | 74 |
| Ta | 80 | 64 | 83 | 90 | 69 | 88 | 79 | 81 | 81 | 81 | 80 | 80 | 80 | 80 | 91 | 110 |
| Ta − Tg | 25 | 7 | 29 | 35 | 29 | 18 | 24 | 26 | 26 | 26 | 25 | 25 | 25 | 25 | 36 | 36 |
| Minimum value of G' for 110° C. to 150° C. | Yes | Yes | Yes | Yes | Yes | Yes | Yes | Yes | Yes | Yes | Yes | Yes | Yes | No | No | Yes |
| Amount of plasticizer (mass %) | 11 | 20 | 9 | 6 | 9 | 14 | 11 | 11 | 11 | 11 | 11 | 11 | 11 | 11 | 11 | 0 |
| Organosilicon polymer surface layer | Yes | Yes | Yes | Yes | Yes | Yes | Yes | Yes | Yes | Yes | Yes | Yes | Yes | No | No | No |
| $(SPr\text{-}SPw)^2 \times Mw$ | 548 | 548 | 548 | 548 | 548 | 548 | 382 | 888 | 548 | 548 | 548 | 548 | 548 | 548 | 548 | — |

The unit for D1 and D4 in the table is μm.

Toner Evaluations

The following evaluations were carried out using an LBP9600C laser printer from Canon, Inc. that had been modified to enable adjustment of its fixation temperature and process speed.

Low-Temperature Fixability

Operating in a normal-temperature, normal-humidity (25° C./50% RH) environment at a process speed of 320 mm/sec, a solid image (toner laid-on level: 0.40 mg/cm$^2$) was formed with the fixation temperature being changed in 5° C. steps. Plain paper (letter size XEROX 4200 paper, Xerox Corporation, 75 g/m$^2$) was used as the transfer material.

The fixed image was rubbed 10 times under a load of 75 g/cm$^2$ using Kimwipes (S-200, Crecia Co. Ltd.), and the low-temperature fixability was evaluated using the temperature at which the percentage decline in the density pre-versus-post-rubbing became less than 5%. The image density was measured using a reflection densitometer (product name: RD918, MacBeth Corporation).

A score of C or above was regarded as excellent in the present invention.

Evaluation Criteria

A: 140° C.

B: 145° C.

C: 150° C.

D: 155° C.

E: 160° C.

Hot Offset Resistance

Operating in a normal-temperature, normal-humidity (25° C./50% RH) environment at a process speed of 320 mm/sec, a solid image (toner laid-on level: 0.9 mg/cm$^2$) was formed with the fixation temperature being changed in 10° C. steps. Plain paper (letter size XEROX 4200 paper, Xerox Corporation, 75 g/m$^2$) was used as the transfer material. The hot offset resistance was evaluated visually. A score of C or better was regarded as excellent in the present invention.

Evaluation Criteria

A: offset is not produced at 210° C.

B: offset is produced at 210° C.

C: offset is produced at 200° C.

D: offset is produced at 190° C.

Gloss

Operating in a normal-temperature, normal-humidity (25° C./50% RH) environment at a process speed of 320 mm/sec, a solid image (toner laid-on level: 0.6 mg/cm$^2$) was formed at a fixation temperature of 180° C. The gloss value was measured using a PG-3D (Nippon Denshoku Industries Co., Ltd.). Letter size plain paper (XEROX 4200 paper, Xerox Corporation, 75 g/m$^2$) was used as the transfer material. A score of C or better was regarded as excellent in the present invention.

Evaluation Criteria

A: the gloss value is equal to or greater than 40

B: the gloss value is less than 40 and equal to or greater than 35

C: the gloss value is less than 35 and equal to or greater than 30

D: the gloss value is less than 30 and equal to or greater than 25

E: the gloss value is less than 25

Fogging

Operating in a high-temperature, high-humidity environment (temperature of 33° C./humidity of 85% RH), a test was run in which 25,000 prints were printed out of a horizontal line image having a print percentage of 1%; the completion of the test was followed by standing for 48 hours; and an additional image was printed out and the reflectance (%) was measured on the non-image area using a "Reflectometer Model TC-6DS" (Tokyo Denshoku Co., Ltd.).

The evaluation was performed using the numerical value (%) provided by subtracting the obtained reflectance from the similarly measured reflectance (%) of the unused print-out paper (reference paper). A smaller numerical value is indicative of a greater suppression of image fogging. The evaluation was performed using plain paper (HP Brochure Paper 200 g, Glossy, Hewlett-Packard, 200 g/m$^2$) in glossy paper mode. A score of C or better was regarded as excellent in the present invention.

Evaluation Criteria

A: less than 0.5%

B: equal to or greater than 0.5% and less than 1.5%

C: equal to or greater than 1.5% and less than 3.0%

D: equal to or greater than 3.0%

Evaluation of Ejected Sheet Sticking Resistance

Operating in a high-temperature, high-humidity environment (temperature of 32.5° C./humidity of 80% RH), 10 prints are first continuously made on both sides of Office Planner A4 paper (areal weight=68 g/m$^2$) using a test chart having a print percentage of 6%. Then, with the 10 prints in a stack, a load is applied for one hour by stacking 7 reams of unopened Office Planner paper (500 sheets/ream, corresponds to 3,500 sheets), and the status during unstacking is subsequently evaluated. A score of C or better was regarded as excellent in the present invention.

Evaluation Criteria

A: Ejected sheet sticking is not produced.

B: While sticking between sheets is seen, image defects after unstacking are not seen.

C: Slight image defects are seen after unstacking.

D: Significant image defects are seen after unstacking.

Examples 1 to 13

The evaluations given above were performed on each of toners 1 to 13 in Examples 1 to 13. The results of the evaluations are given in Table 3.

Comparative Examples 1 to 3

The evaluations given above were performed on each of comparative toners 1 to 3 in Comparative Examples 1 to 3. The results of the evaluations are given in Table 3.

TABLE 3

| Toner | Low-temperature fixability | Gloss | Hot offset resistance | Ejected sheet sticking resistance | Fogging |
|---|---|---|---|---|---|
| Toner 1 | A | A(45) | A | A | A(0.1) |
| Toner 2 | A | A(45) | A | B | B(0.6) |
| Toner 3 | B | A(42) | A | A | A(0.1) |
| Toner 4 | C | B(38) | A | A | A(0.2) |
| Toner 5 | A | A(45) | A | B | A(0.1) |
| Toner 6 | B | B(36) | A | A | A(0.1) |
| Toner 7 | A | A(44) | A | B | A(0.2) |
| Toner 8 | C | B(36) | A | A | A(0.1) |
| Toner 9 | A | A(45) | A | C | A(0.2) |
| Toner 10 | A | A(46) | A | A | C(1.8) |
| Toner 11 | C | A(45) | A | C | C(2.1) |
| Toner 12 | C | A(44) | A | C | C(2.2) |
| Toner 13 | C | A(45) | A | C | C(1.9) |
| Comparative toner 1 | A | B(35) | D | D | D(8.0) |
| Comparative toner 2 | D | E(8) | B | D | D(4.5) |
| Comparative toner 3 | E | E(13) | C | B | D(7.7) |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-197856, filed Oct. 19, 2018, which is hereby incorporated by reference herein in its entirety.

What is claimed is:

1. A toner comprising a toner particle, said toner particle comprising a binder resin, a release agent and a plasticizer, said plasticizer being an ester compound represented by formulae (2) or (3)

(2)

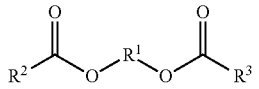

(3)

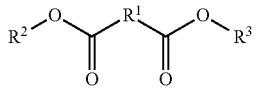

where $R^1$ represents an alkylene group having from 1 to 6 carbon atoms and $R^2$ and $R^3$ independently represent a straight-chain alkyl group having from 11 to 25 carbon atoms, wherein $$40° C. \leq Tg \leq 70° C.,$$

$$60° C. \leq Ta \leq 90° C., \text{ and}$$

$$0° C. \leq Ta - Tg \leq 35° C.$$

when Ta is a temperature when $G'=1.0\times10^5$ Pa in a dynamic viscoelastic measurement on the toner, and Tg is a glass transition temperature in a differential scanning calorimetric measurement on the toner, the toner has a storage elastic modulus G' having a minimum value in a range of 110 to 150° C. in a dynamic viscoelastic measurement on the toner measured using a rotational plate rheometer at an oscillation frequency of 1.0 Hz (6.28 rad/s) and a ramp rate of 2.0° C./minute in temperature sweep mode in a temperature range of 50 to 160° C., and $$(SPr-SPw)^2\times Mw\leq 680$$

when SPw is a solubility parameters of the plasticizer, SPr is a solubility parameter of the binder resin, and Mw is a weight-average molecular weight of the plasticizer.

2. The toner according to claim 1, wherein a content of the plasticizer in the toner is 5 to 30 mass %.

3. The toner according to claim 1, wherein the toner particle has a surface layer that contains an organosilicon polymer.

4. The toner according to claim 3, wherein the organosilicon polymer has a structure represented by $R—SiO_{3/2}$ when R represents a hydrocarbon group or aryl group having 1 to 6 carbon atoms.

5. The toner according to claim 1, wherein the toner particle contains a carboxy group-containing styrene resin having an acid value of 5 to 25 mg KOH/g.

6. The toner according to claim 1, wherein the binder resin contains a styrene-acrylic resin.

7. The toner according to claim 1, wherein the toner particle is a suspension polymerized toner particle.

8. A toner comprising a toner particle, said toner particle comprising a binder resin and a release agent, wherein $$40°\ C.\leq Tg\leq 70°\ C.,$$

$$60°\ C.\leq Ta\leq 90°\ C., \text{ and}$$

$$0°\ C.\leq Ta-Tg\leq 35°\ C.$$

when Ta is a temperature when $G'=1.0\times10^5$ Pa in a dynamic viscoelastic measurement on the toner, and Tg is a glass transition temperature in a differential scanning calorimetric measurement on the toner, the toner has a storage elastic modulus G' having a minimum value in a range of 110 to 150° C. in a dynamic viscoelastic measurement on the toner measured using a rotational plate rheometer at an oscillation frequency of 1.0 Hz (6.28 rad/s) and a ramp rate of 2.0° C./minute in temperature sweep mode in a temperature range of 50 to 160° C., and the toner particle contains a carboxy group-containing styrene resin having an acid value of 5 to 25 mg KOH/g.

* * * * *